US006805681B2

(12) United States Patent
Yokoyama

(10) Patent No.: US 6,805,681 B2
(45) Date of Patent: Oct. 19, 2004

(54) TAPING SOCKS

(75) Inventor: Yoshiyuki Yokoyama, Kakogawa (JP)

(73) Assignee: Atsuhiro Ueda, Kobe (JP)

( * ) Notice: Subject to any disclaimer, the term of this patent is extended or adjusted under 35 U.S.C. 154(b) by 3 days.

(21) Appl. No.: 10/458,026

(22) Filed: Jun. 9, 2003

(65) Prior Publication Data

US 2003/0230121 A1 Dec. 18, 2003

(30) Foreign Application Priority Data

Jun. 14, 2002 (JP) ..... 2002-003618 U

(51) Int. Cl.[7] ..... A61F 13/00
(52) U.S. Cl. ..... 602/65; 602/66; 2/239
(58) Field of Search ..... 602/60, 63, 65, 602/75; 128/882; 2/239–242, 455

(56) References Cited

U.S. PATENT DOCUMENTS 967,585 A * 8/1910 Tuefel
1,037,441 A * 9/1912 Collis
3,421,503 A * 1/1969 Kaplan
5,617,745 A * 4/1997 Della Corte ..... 2/239
5,833,640 A * 11/1998 Vazquez ..... 602/27
6,286,151 B1 * 9/2001 Lambertz ..... 2/239

* cited by examiner

*Primary Examiner*—Michael A. Brown
(74) *Attorney, Agent, or Firm*—Curtis L. Harrington

(57) ABSTRACT

The purpose of this invention is to provide taping socks which hold the ankle so as to protect the instep or the Achilles' tendon and prevent intorelance during walking or exercising. In the taping socks which have tightening parts woven in the socks, the first tightening part 7*a* is to tighten the Achilles' tendon and to be knitted around an ankle part S00, and a second tightening part 7*b* is to tighten an arch part P00 and to be knitted around the instep part 5. The said first tightening part 7*a* and said second tightening part 7*b* are crossed in an X shape at a flection part of front side to protect the Achilles' tendon and the instep part as well as hold the ankle part S00.

3 Claims, 4 Drawing Sheets

TAPING SOCKS

BACKGROUND OF THE INVENTION

1. Field of the Invention

The present invention relates to taping socks which have tightening parts woven in the socks.

2. Description of the Related Art

The taping socks which have a tightening part from a sole part to an instep part of the socks have already sold. However, the socks mainly tighten the arch part.

On the other hand, a prior art which has two tightening parts to tighten an ankle part is well-known in the registration utility model No. 3069414. However, these socks are suitable for infant, and its purpose is to prevent them from sliding down.

In the past, the taping socks, which holds the ankle in order to protect Achilles' tendon and the instep and to prevent intorelance during walking or exercising, has not existed.

In view of above-mentioned situations, the subject of the present invention is to provide the taping socks which hold the ankle to protect the instep and Achilles' tendon and to prevent intorelance during walking or existence.

BRIEF DESCRIPTION OF THE DRAWINGS

FIG. 2 is a perspective view from the front showing that the taping sock of FIG. 1 is pulled on.

DESCRIPTION OF PREFERRED EMBODIMENTS OF THE INVENTION

The present invention has solved the above situations by providing the taping socks which have two tightening parts. The first tightening part is to tighten the Achilles' tendon and to be knitted around an ankle part, and a second tightening part is to tighten an arch part and to be knitted around the instep part. The said first tightening part and said second tightening part are crossed in an X shape at a flection part of front side to protect the Achilles' tendon and the instep part as well as hold the ankle part.

The taping socks of the present invention are socks which have a tightening part in the socks and obtain supporter effect by inlay stich with woven rubber thread except for a rip top part.

The socks of the present invention can be applied to from child except for infant to adult.

Figure 1:
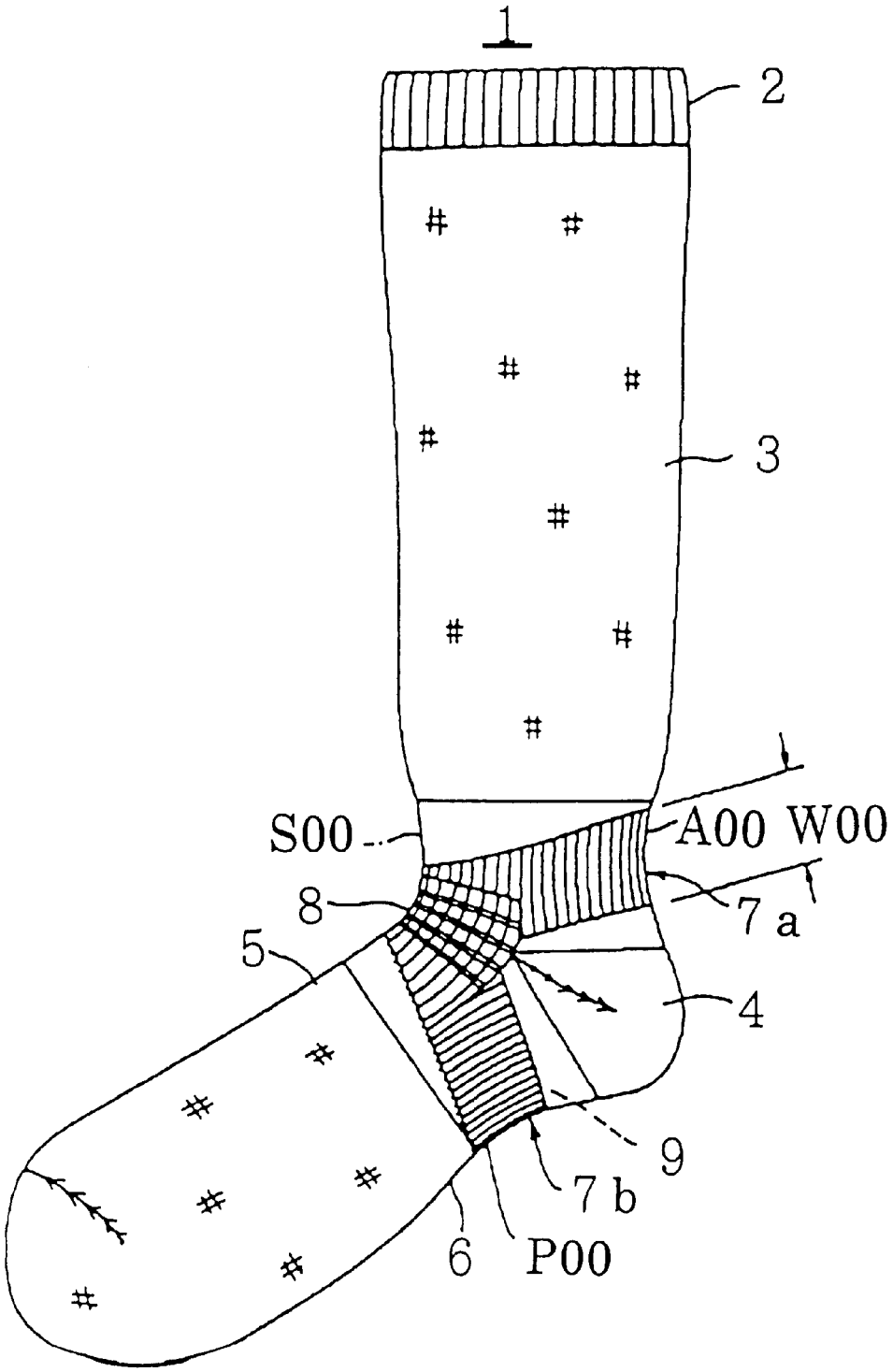
FIG. 1 is a side view showing an example of the taping sock of high socks in this invention.
Figure 2:
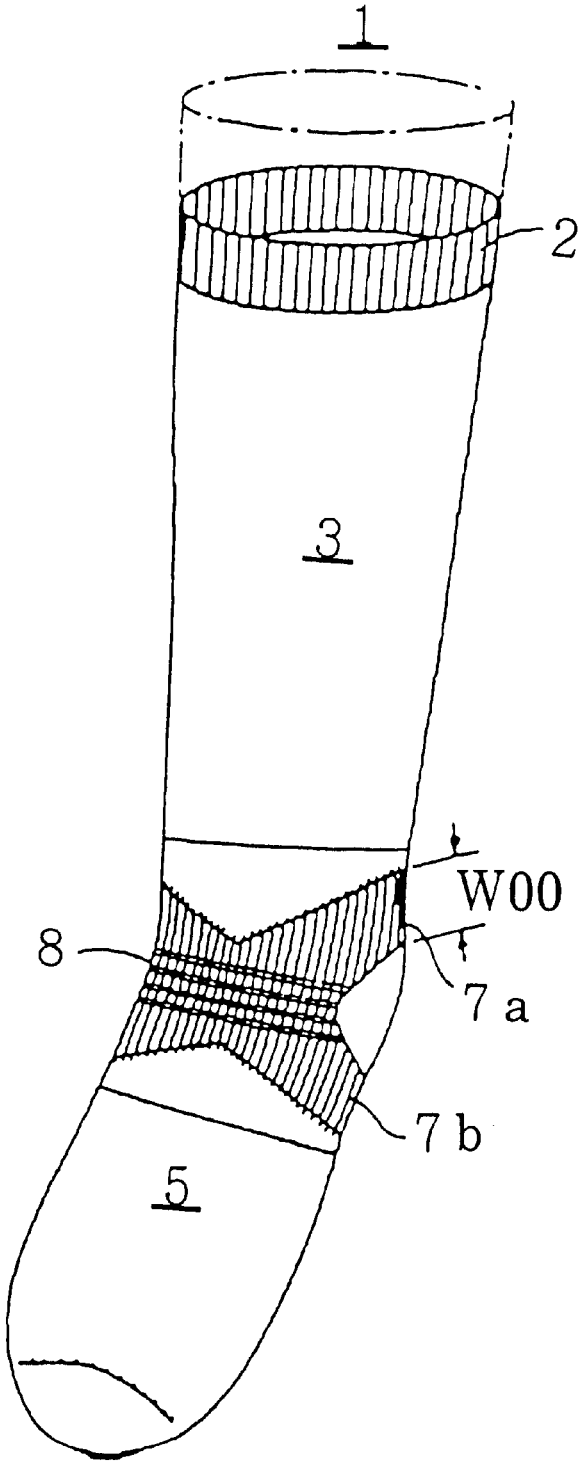

Next, according the drawings, the socks of the present invention are explained in detail. FIG. 1 is a side view showing an example of the taping socks of high sock, and FIG. 2 is a perspective view seen from a front side showing that the taping sock of FIG. 1 is pulled on.

In this example, the taping sock 1 of the present invention shows an example of a high sock with a length of below knee region. However, the taping socks of the present invention are not constrained to the high socks, and these are applied to a stocking, overknee, short socks and anklet foot cover.

Further, the taping sock 1 is used for outdoor sports. These socks are for walking, trekking, hiking, climbing, and various kinds of sports such as soccer, basketball, baseball and golf. However, the taping socks of the present invention are not constrained to outdoor sports, but also can be widely pulled on for health purpose or with casual or business cloth.

Top part of the taping sock 1 is a rip top part 2 of casting on, and it is a tightening part by inlay stich woven rubber threads. Below this top part, a body part 3 of the sock is knitted, and a lower edge of the body part comes to an ankle part S00 of user. Because there is the Achilles' tendon A10 in the back side of the ankle part S00, it is necessary to protect the ankle part S00, which supports heavy human body, not to sprain ankles. Socks 1 has heel part 4, instep part 5 and sole part 6, which continue to be knitted from body part 3.

The taping sock 1 has other tightening parts except for the rip top part 2. One of them is a first tightening part 7*a* knitted to around the ankle part S00 to tighten the Achilles' tendon A00. The other is a second tightening part 7*b*, which tightens the arch part P00, and is knitted around instep part 5. The first tightening part 7*a* and second tightening part 7*b* are combined in crossing X shape at a flextion part 8 of front side as shown in FIG. 2. The flexion part 8 has a horizontal rib stitch structure for easy bending. The instep part 5 of the first tightening part 7*a*, and the second tightening part 7*b* are dappled inlay stich structures with woven rubber thread. The first tightening part 7*a* and second tightening part 7*b* incline to course direction. Therefore, in its boundary, a cut thread 9 by cut off rib stich comes out slightly, but its length is short and is tightened firmly and is not necessary to be concerned.

The tightening part 7*a*'s and 7*b*'s width W00 in the example is 3 cm. These widths are not constrained, but it is rather preferable to have the width of more than 2 cm. If the widths of the tightening part 7*a* and 7*b*, which protect Achilles' tendon A10 and the instep part 5 respectively, are less than 2 cm, it is too narrow to achieve the desired effects. The width of tightening part of infant socks is about 1 cm since its purpose is different from one of this invention. As for the taping socks 1 in this invention, the ankle part S00 is tightened firmly by the taping of the tightening part 7*a* and 7*b*.

The tightening part is a substantial part of the present invention, and the tightening parts of the ankle part and the instep part are combined at the front side. At both ends of the heel parts of the backside, the first tightening part covers Achilles' tendon and the second tightening part covers the arch part. When the holding is firmly, it is not necessary to cover all of of the arch part.

Figure 3:
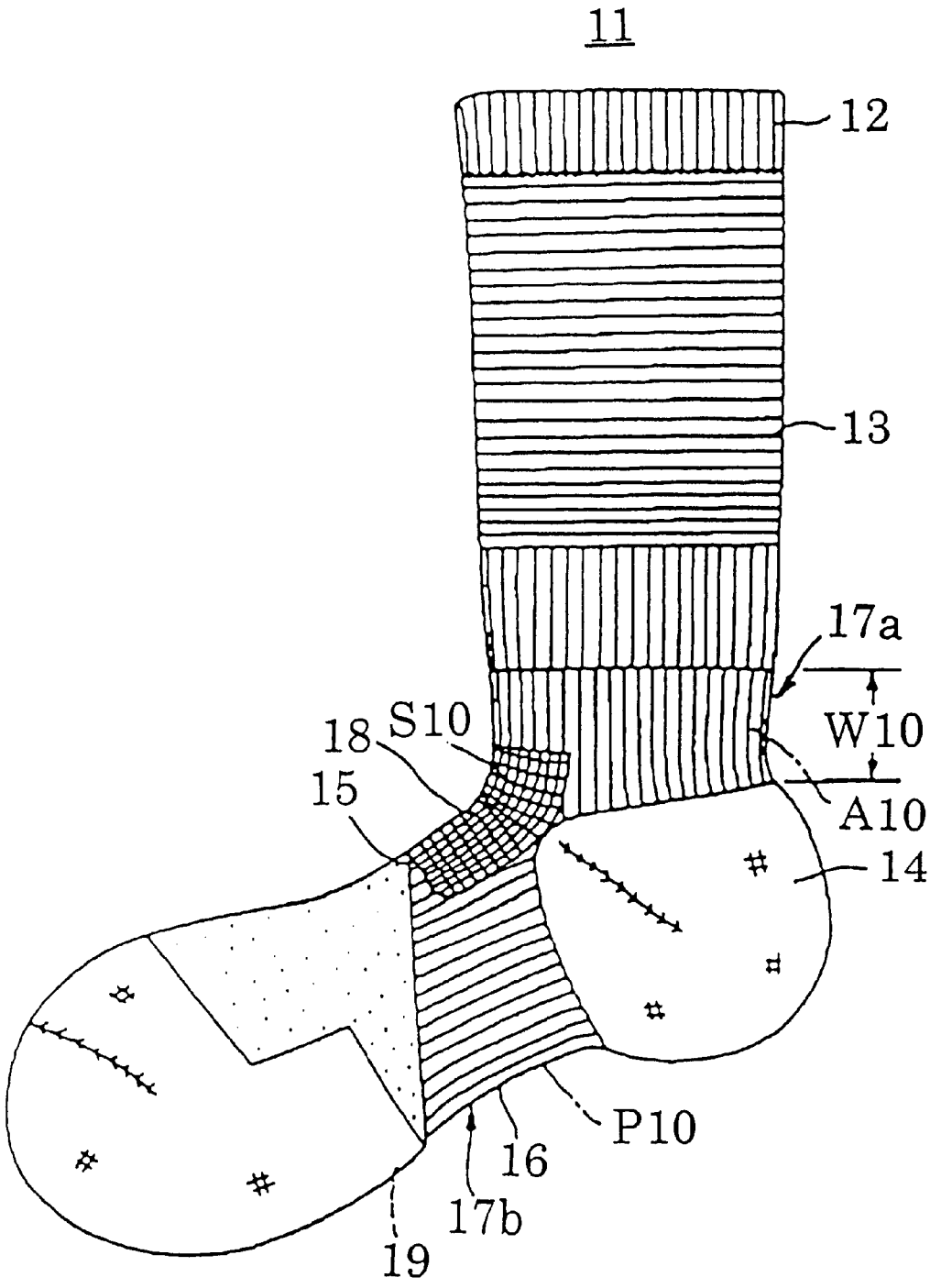
FIG. 3 is a side view of longish short sock showing other example of the taping socks in this invention.

FIG. 3 is a side view showing other example of the taping socks of longish short shocks in this invention.

The taping socks in this example are longish short shock 11. The top part of the short sock 11 is knitted in double welt for makeup. The inlay stitch with rubber thread Woven is a long vertical rib stitch structure from a rib top part 12 to a body part 13, which is considered not to slip down, and, moreover, is fashionable with horizontal stripes. The sock in this invention characterized in that it is easy to pull on by making tightening part of rib top easy fit and long, and widening its top part along with the shape of the leg, which has been called taper socks for some time back.

The lower end of body part 13 comes to an ankle part S10 of the human body. Because there is the Achilles' tendon A10 in the backside of the ankle part S10, it is necessary to protect the ankle part S10, which supports heavy human body, not to sprain ankles. The sock 11 has a heel part 14, instep part 15 and sole part 16, which continue to be knitted from the body part 13.

The taping sock 11 in this invention has the first tightening part 17*a*, which continues to be knitted from a vertical rib stitch structure of the body part 13, tightens the Achilles' tendon A10, and is knitted around the ankle part S10. It also has the second tightening part 17*b*, which combines with the first tightening part 17*a* at the front side, tightens the whole arch part P10, and is knitted around instep part 15. Therefore, the first tightening part 17*a* and the second tightening part 17*b* are combined in a crossing X shape at the flexion part 18 of front side. The flexion part 18 has horizontal rib stitch structure for easy bending. An instep part 15 of the first tightening part 17*a* and the second tightening part 17*b* are dappled inlay stitch structures with rubber thread woven. So the cut thread 19 by cut off stitch comes out slightly on its boundary of backside, but it is tightened firmly and is not necessary to be concerned.

The first tightening part 17*a*'s width W10 in the example is 3.5 cm. The width of the arch part of the second tightening part 17*b* is wider 5.5 cm. These widths are not constrained, but it is rather preferable to have the width of more than 2 cm. If the widths of tightening part 17*a* and 17*b*, which protect the Achilles' tendon A10 and the instep part 15 respectively, are less than 2 cm, it is too narrow to achieve the desired effects. The width of tightening part of infant socks is about 1 cm since its purpose is different from one of this invention. As for the taping socks 11 in this invention, the ankle part S10 is tightened firmly by the taping of the tightening part 17*a* and 17*b*.

Figure 4:
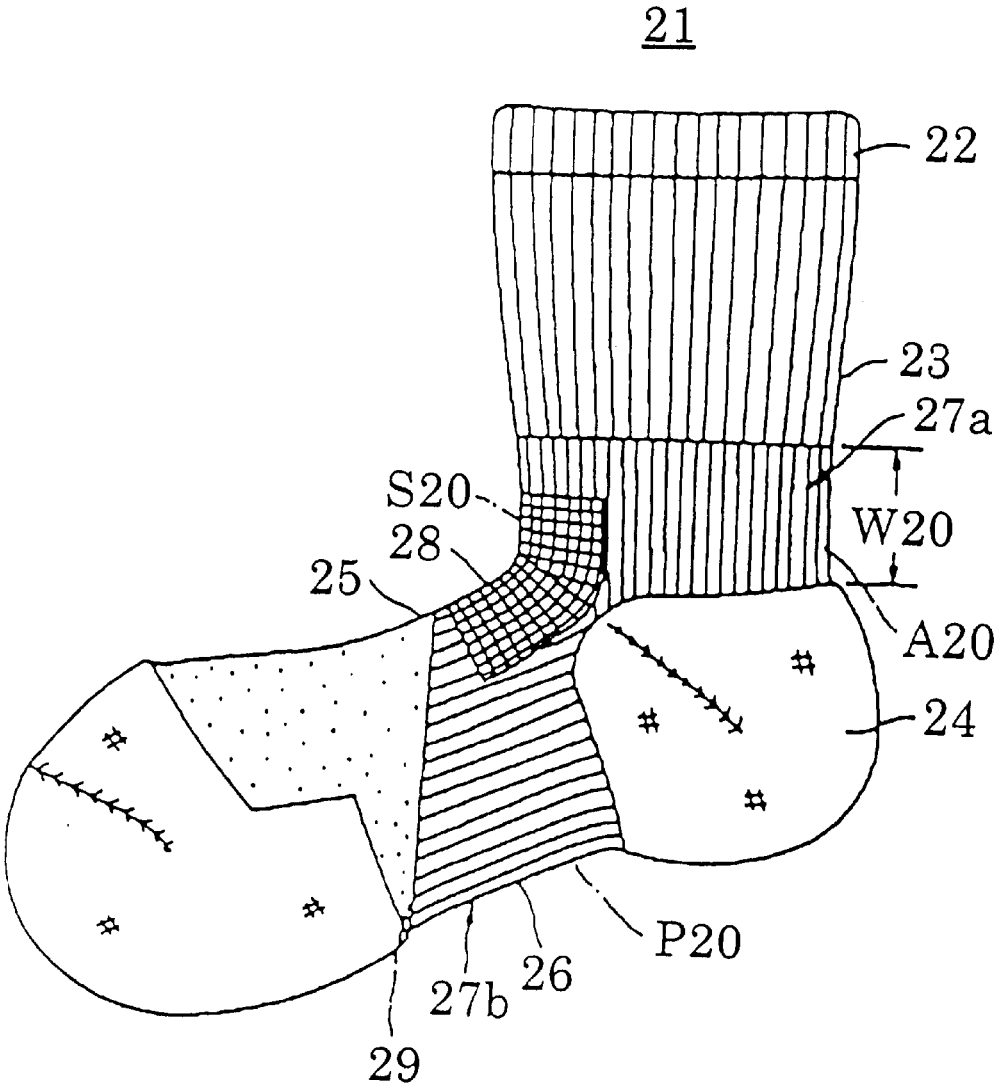
FIG. 4 is a side view of short sock showing other example of the taping socks in this invention.

FIG. 4 is a side view showing other example of the taping socks of short shocks in this invention. The taping socks in this example are short shocks 21.

The top part of the taping socks 21 is knitted in double welt for makeup. The inlay stitch with rubber thread woven is a long vertical rib stitch structure from a rib top part 22 to a body part 23, which is considered not to slip down, and, moreover, is fashionable with patterns.

The lower end of the body part 23 comes to an ankle part S20 of the human body. Because there is the Achilles' tendon A20 in the backside of the ankle part S20, it is necessary to protect the ankle part S20, which supports heavy human body, not to sprain ankles. The sock 21 has a heel part 24, instep part 25 and sole part 26, which continue to be knitted from the body part 23.

The taping socks 21 in this invention has the first tightening part 27*a*, which continues to be knitted from vertical rib stitch structure of the body part 23, tightens the Achilles' tendon A20, and is knitted around the ankle part S20. It also has the second tightening part 27*b*, which combines with the first tightening part 27*a* at the front side, tightens the whole arch part P20, and is knitted around the instep part 25. Therefore, the first tightening part 27*a* and the second tightening part 27*b* are combined in a crossing X shape at a flexion part 28 of front side. The flexion part 28 has horizontal rib stitch structure for easy bending. The instep part 25 of the first tightening part 27*a* and the second tightening part 27*b* are dappled inlay stitch structures with rubber thread woven. So the cut thread 29 by cut-off stitch comes out slightly on its boundary of backside, but it is tightened firmly and is not necessary to be concerned.

The first tightening part 27*a*'s width W20 in the example is 3.5 cm. The width of arch part of the second tightening part 27*b* is wider 5.5 cm. These widths are not constrained, but it is rather preferable to have the width of more than 2 cm. If the widths of the tightening part 27*a* and 27*b*, which protect the Achilles' tendon A20 and the instep part 25 respectively, are less than 2 cm, it is too narrow to achieve the desired effects. The width of tightening part of the infant socks is about 1 cm since its purpose is different from one of this invention. As for the taping socks 21 in this invention, the ankle part S20 is tightened firmly by the taping of the tightening part 27*a* and 27*b*.

Effect of the Invention

The taping socks in this invention can protect the instep and the Achilles' tendon during walking or doing exercises.

The taping socks in this invention can hold ankle firmly and prevent it from being sprained.

What is claimed is:

1. Taping socks wherein, in the taping socks which have tightening parts woven in the socks, a first tightening part is to tighten the Achilles' tendon and is knitted so that the first tightening part surrounds an ankle part, and a second tightening part is to tighten an arch part and is knitted so that the second tightening part surrounds the instep part; the said first tightening part and said second tightening part are crossed in an X shape at a flection part of front side to protect the Achilles' tendon and the instep part as well as hold the ankle part; said flection part has horizontal rib structure.

2. The taping socks described in claim 1 wherein, the first and second tightening parts have width of more than 2 cm.

3. The taping socks described in claim 1 wherein, the socks includes each of a stocking, overknee, high socks, short socks and anklet foot cover.

* * * * *